US012529205B2

(12) United States Patent
Manchester et al.

(10) Patent No.: US 12,529,205 B2
(45) Date of Patent: Jan. 20, 2026

(54) DEVICE, METHOD AND ASSEMBLY FOR PROVIDING AN ELONGATE ELEMENT IN A SEABED

(71) Applicant: Royal IHC Limited, Newcastle Upon Tyne (GB)

(72) Inventors: Jonathan Ralph Manchester, Stocksfield (GB); Michael John Watchorn, Stocksfield (GB)

(73) Assignee: Royal IHC Limited, Stocksfield (GB)

( * ) Notice: Subject to any disclaimer, the term of this patent is extended or adjusted under 35 U.S.C. 154(b) by 160 days.

(21) Appl. No.: 17/775,388

(22) PCT Filed: Nov. 5, 2020

(86) PCT No.: PCT/EP2020/081129
§ 371 (c)(1),
(2) Date: May 9, 2022

(87) PCT Pub. No.: WO2021/094193
PCT Pub. Date: May 20, 2021

(65) Prior Publication Data

US 2022/0381004 A1 Dec. 1, 2022

(30) Foreign Application Priority Data

Nov. 14, 2019 (NL) ..... 2024240

(51) Int. Cl.
*E02F 5/14* (2006.01)
*E02F 5/10* (2006.01)

(52) U.S. Cl.
CPC ..... *E02F 5/14* (2013.01); *E02F 5/10* (2013.01); *E02F 5/106* (2013.01); *E02F 5/104* (2013.01)

(58) Field of Classification Search
CPC ..... E02F 5/104; E02F 5/106; E02F 5/14; E02F 5/10; E02F 5/101; E02F 5/22; E02F 5/02

(Continued)

(56) References Cited

U.S. PATENT DOCUMENTS 2,593,679 A * 4/1952 Kaupke ..... A01B 35/14 172/699
5,755,530 A * 5/1998 Garren ..... E02F 5/14 405/174

(Continued)

FOREIGN PATENT DOCUMENTS

CN 85103961 A 12/1986
CN 1184192 A 6/1998

(Continued)

OTHER PUBLICATIONS

International Search Report and Written Opinion issued in counterpart PCT Application No. PCT/EP2020/081129 dated Mar. 9, 2021 (nine (9) pages).

(Continued)

*Primary Examiner* — Christopher J Sebesta
*Assistant Examiner* — Audrey L Lusk
(74) *Attorney, Agent, or Firm* — E. Eric Mills; Nicholas P. Stadnyk; Maynard Nexsen PC

(57) ABSTRACT

A device for providing an elongated element in a seabed is disclosed. The device comprises a main body having trench forming means for forming a trench in a seabed, and a receiving section for receiving an elongated element. The main body is adapted to guide said elongated element, from said receiving section, into a trench formed by said trench forming means. The device further includes supporting means defining a contact surface for supporting said main body with respect to said seabed, wherein the receiving section is configured to receive the elongated element from (Continued)

a side substantially opposite to the contact surface along a loading path. The device further includes a drawbar connected to said main body. The drawbar is movable from a loading position to a towing position. In the towing position said device is towable in a trenching direction via a towing line connected to said drawbar. In the loading position the drawbar is spaced apart from the loading path to allow the elongated element to be loaded into the receiving section along the loading path.

16 Claims, 13 Drawing Sheets

(58) Field of Classification Search
USPC ..... 37/348
See application file for complete search history.

(56) References Cited

U.S. PATENT DOCUMENTS

| | | | | |
|---|---|---|---|---|
| 6,050,009 | A * | 4/2000 | Adamson | E02F 5/104 405/161 |
| 6,061,932 | A | 5/2000 | Rowley | |
| 6,837,653 | B1 * | 1/2005 | Grinsted | E02F 5/145 405/164 |
| 2004/0031174 | A1 | 2/2004 | Ballard | |
| 2016/0376766 | A1 * | 12/2016 | Wilson | E02F 5/14 37/342 |

FOREIGN PATENT DOCUMENTS

| | | | | |
|---|---|---|---|---|
| CN | 1800521 | A | 7/2006 | |
| CN | 104428471 | A | 3/2015 | |
| CN | 207620024 | U | 7/2018 | |
| CN | 109208673 | A | 1/2019 | |
| CN | 208486302 | U | 2/2019 | |
| CN | 109790697 | A | 5/2019 | |
| EP | 0123468 | A1 | 10/1984 | |
| EP | 3121917 | A1 | 1/2017 | |
| FR | 2497915 | A1 | 7/1982 | |
| GB | 2353304 | A | 2/2001 | |
| GB | 2354886 | A | 4/2001 | |
| GB | 2545925 | A * | 7/2017 | E02F 5/104 |
| JP | H633612 | B2 | 5/1994 | |
| SU | 1002466 | A1 | 3/1983 | |
| WO | 2017115070 | A1 | 7/2017 | |

OTHER PUBLICATIONS

Search Report issued in counterpart NL Application No. NL 2024240 dated Jul. 20, 2020 (eight (8) pages).

* cited by examiner

DEVICE, METHOD AND ASSEMBLY FOR PROVIDING AN ELONGATE ELEMENT IN A SEABED

CROSS REFERENCE TO RELATED APPLICATIONS

This application is a 35 U.S.C. § 371 U.S. national phase entry of International Patent Application No. PCT/EP2020/081129 having an international filing date of Nov. 5, 2020, which claims the benefit of The Netherlands Patent Application No. 2024240 filed Nov. 14, 2019, each of which is incorporated herein by reference in its entirety.

TECHNICAL FIELD

The present invention relates to a device and a method for providing an elongate element in a seabed, as well as an assembly comprising a vessel and said device.

BACKGROUND TO THE INVENTION

Ploughs are commonly used for ploughing a trench in a seabed and simultaneously laying an elongate element, for example cables, therein. A known plough 100 (in particular, that disclosed in GB2354886 A) is illustrated in FIGS. 1*a* and 1*b*. The plough 100 comprises a plough body having a frontside and a rearside. At the frontside, the plough body comprises a drawbar 102 which is to be connected to a towing line, and a bell mouth 104, the bell mouth 104 being adapted to receive an elongate element 101 therethrough. Following receipt of an elongate element, the elongate element is guided through the plough body towards the rearside thereof.

The plough 100 includes a ploughing knife or blade 106 arranged to cut a trench in the seabed as the plough is towed. The plough 100 further includes a depressor 108, extending towards the rearside of the plough body, the depressor 108 being arranged to guide the elongate element into a trench cut by the ploughing knife. In the illustrated arrangement, the depressor 108 is configured to cooperate with a rear surface of the ploughing knife 106, such that the elongate element is guided between the depressor and the ploughing knife towards the trench, before being urged downwardly into the trench by the depressor 108.

Although any suitable ploughing means or ploughing knife may be used, in the arrangement illustrated in FIGS. 1*a* and 1*b* the ploughing knife 106 includes a plurality of cutting blades $\mathbf{107}_{1,2}$ arranged as an upper blade $\mathbf{107}_2$ and a lower blade $\mathbf{107}_1$ (although any number of blades are possible). The blades are arranged with an offset along the trenching direction, such that the trench is cut through a succession of cuts (at increasing depths) by the individual blades.

In use, the elongate element is loaded onto the plough 100 by providing an elongate element 101 into the bell mouth 104. The elongate element is drawn into the bell mouth 104 and towards the ploughing knife 106 (for example by means of a grabber element configured to grab the elongate element from the front of the plough). Once loaded, the plough 100 is drawn over the surface of the seabed via a tow line connected to the drawbar 102, often by the vessel. As the plough 100 is drawn over the surface a trench is formed and the elongate element is guided into the trench.

For known ploughs, it is relatively difficult to load the plough, in particular underwater. As such, loading of the cable is typically undertaken prior to the deployment of the plough (i.e. while the plough is located on a vessel). With cables, for example power transmission cables, going into deeper water, loading the cable into the plough prior to deployment can lead to the cable bend limit being exceeded. Previous attempts to develop a plough that can be loaded on the seabed have relied on the incorporation of lifting means to load the plough, i.e. to mimic the deck loading procedure. As such there is a need to be able to more effectively load cable into a plough which is already positioned on the sea bed.

EP3121917 A1 discloses a plough for burying a cable in a trench in a sea bed. Said plough comprises a cable support that is movable between a first position, in which the cable support supports part of the cable above the plough share during formation of the trench, by allowing said part of the cable to rest on the cable support, and a second position, in which said part of the cable can be loaded onto the cable support, wherein the second position is lower than the first position. As such, said plough can be placed over a cable located on the seabed, wherein a part of said cable (located on the seabed) can be lifted from said seabed to said first position.

SUMMARY OF THE INVENTION

According to a first aspect of the present invention there is provided a device for providing an elongate element in a seabed, the device comprising:

- a main body having:
  - trench forming means for forming a trench in a seabed, and
  - a receiving section for receiving an elongate element, wherein said main body is adapted to guide said elongate element, from said receiving section, into a trench formed by said trench forming means;
- supporting means defining a contact surface for supporting said main body with respect to said seabed, wherein the receiving section is configured to receive the elongate element from a side substantially opposite to the contact surface along a loading path; and
- a drawbar connected to said main body;
- wherein said drawbar is movable from a loading position to a towing position,
- wherein in the towing position said device is towable in a trenching direction via a towing line connected to said drawbar,
- wherein in the loading position the drawbar is spaced apart from the loading path to allow the elongate element to be loaded into the receiving section along the loading path elongate.

This arrangement allows for an elongate element to be loaded into the device with less difficulty, when compared with known devices. In particular, this arrangement allows for the plough to be 'top-loaded' with an elongate element (i.e. loaded from above), as the drawbar can be configured to allow free passage along the loading path into the receiving section from the side opposite to the contact surface. Differently put; the drawbar may be configured so as to not obstruct the loading path into the receiving section from above the plough. In other words the drawbar is spaced apart from the loading path when in a loading position. Once loaded, the receiving section can then be (substantially) 'closed' such that the device can be towed. By allowing top-loading of an elongate element, the device can be loaded while positioned on the a seabed.

Since the plough in accordance with the present invention does not have to be lowered over the elongate element, there is less risk of damage to the elongate element due to the self-weight contact forces, which could incur. In addition, the plough may be free from additional loading means for loading the elongate element.

Aptly the device further includes actuator means for moving the drawbar from said loading position to said towing position.

Aptly, the drawbar obstructs the loading path into said receiving section in said towing position. That is, the drawbar is movable from a position in which the loading path of the elongate element to the receiving section is unobstructed, to a position in which the loading path of the elongate element is obstructed (but the drawbar can be used for towing the plough in a towing/trenching operation).

Aptly, the drawbar is movable between the loading position and the towing position. This allows the processes of towing and loading (or unloading when required) to be interchanged as required. In addition, this allows the device to be deployed in the towing position, loaded with an elongate element and returned to the towing position so to perform the required trenching operation.

Aptly, the drawbar includes a first engagement portion and a second engagement portion spaced apart from said first engagement portion, each of said first and second engagement portions being suitable for engaging a towing line. That is, the drawbar (and hence plough) is towed by two towing lines (or two ends of a towing line) to ensure the plough is towed in a stable manner.

Aptly, the drawbar is movable from said loading position to said towing position around at least a first axis extending (substantially) perpendicular with respect to a lateral plane of the plough, or perpendicular to the contact surface. That is, when moving from said loading position to said towing position, the drawbar can be moved, e.g. rotated, around at least a first axis extending perpendicular with respect to the lateral plane of the plough and optionally also the contact surface. In particular, said first axis is (substantially) vertical when the device is positioned on a horizontal seabed. Even more in particular, the first axis extends (substantially) perpendicular to said trenching (i.e. ploughing) direction (and) in a (substantially) vertical direction. In practice, this helps the towing line extending from the first and second engagement portions to remain more evenly tensioned, in particular, in case the towing line is connected to a vessel located at the surface of a body of water, with respect to the vessel. Accordingly, the chance of slack on the towing line is reduced. By reducing the likelihood of slack in the towing lines, loading of the elongate element into the receiving section is made less difficult (as slack on the towing lines can result in the towing line getting in the way of an elongate element to be loaded into the receiving section).

Aptly, the drawbar is movable around a second axis that extends at least substantially perpendicular to said trenching direction and substantially perpendicular to said first axis. That is, the movement of the drawbar from the loading position to the towing position may be a 2-stage movement. The intermediate position (between the loading position and the towing position) may correspond to a launch and recovery position, which allows the plough to be launched from a vessel, or recovered to a vessel.

Aptly, the device includes a bell mouth located at an upstream end of the receiving section, the bell mouth being adapted to receive (and guide) an elongate element through the receiving section. In particular, the bell mouth is arranged to limit radial movement of an elongate element when the elongate element is arranged in the receiving section. Even more in particular, the bell mouth is adapted to limit movement of the elongate element in direction(s) other than the trenching direction. Aptly, the bell mouth is movable between a loading position (wherein the elongate element can be loaded, in particular top-loaded, without being obstructed by the bell mouth) and an operational position. In other words, the bell mouth is movable from an operational position, wherein (at least part of) the receiving section is limited, to a loading position, wherein the bell mouth is (moved) away from (i.e. out of) the loading path.

Aptly, the device includes a depressor extending from/at a downstream side of the main body, the depressor being arranged to guide the elongate element into a trench cut by the trench forming means. In particular, the depressor is arranged to limit radial movement of the elongate element away from the trench forming means. Aptly, the depressor is movable between a loading position (wherein the elongate element can be loaded, in particular top-loaded, without being obstructed by the depressor) and an operational position. In other words, the depressor is movable from an operational position, wherein (at least part of) the receiving section is limited, to a loading position, wherein the depressor is (moved) away from (i.e. out of) the loading path.

Aptly, the trench forming means comprise a trenching knife, trenching blade or share. Aptly, the supporting means comprises at least one skid and at least one actuator to actuate said at least one skid with respect to said main body. In examples, the at least one skid is located towards the front, or upstream end, of the device. In such examples, the at least one skid may include a single wide front skid or two or more front skids. In some examples, the supporting means may include more than one skid, with at least one skid located towards the front, or upstream end, of the device (i.e. at least one front skid) and at least one skid located towards/at the rear, or downstream end, of the device (i.e. at least one rear skid or stabiliser). In examples where the supporting means includes more than one skid, there may be a single actuator, or actuator system, configured to actuate the skids. Alternatively, there may be a separate actuator for each skid.

Aptly, the receiving section comprises a U-shaped frame, or a V-shaped frame for centralizing said elongate element. Additionally or alternatively, the receiving section comprises a diabolo roller for centering the elongate element in/at the receiving section. In particular said diabolo roller has a longitudinal axis extending (substantially) orthogonally with respect to said ploughing direction, wherein, along said longitudinal axis, a central portion of said diabolo roller has a smaller diameter than outer portions of said diabolo roller.

Aptly, the device further comprises guiding means for guiding an elongate element towards said receiving section. Such guiding means may help guide or direct the elongate element towards the receiving section and assist in top-loading the plough.

Aptly, the device further comprises grabbing or capturing means for grabbing or capturing an elongate element.

According to a second aspect of the present invention there is provided a method of loading an elongate element onto a device for providing an elongate element in a seabed, the method comprising the steps of:

- providing a device in accordance with the first aspect of the invention on a seabed, wherein said drawbar in the loading position;
- providing an elongate element;
- loading said elongate element into said receiving section from the side substantially opposite to the contact surface, along the loading path.

This method allows for an elongate element to be loaded into the device with less difficulty, when compared with known methods. In particular, this method allows for an elongate element to be 'top-loaded' (i.e. loaded from above). By allowing top-loading of an elongate element, the device can be loaded while positioned on the a seabed.

Aptly, the method further includes the step of moving said drawbar to said towing position after loading the elongate element into said receiving section. As such, the elongate element is loaded into the plough and then the plough can then be towed with the elongate element loaded thereon.

Aptly, the device is provided in the towing position or in a launch and recovery position. Aptly, the method further comprises the step of moving the drawbar from the towing position or launch and recovery position to the loading position prior to loading the elongate element into the receiving section. That is, initially the device is in a non-loading position (i.e. the device having been used in a towing operation or having been deployed from a vessel). Subsequently, the drawbar is moved to the loading position to allow loading (and subsequent towing) of the device.

According to a third aspect of the present invention there is provided a method of providing an elongate element in a seabed, the method comprising the steps of:

- providing a device in accordance with the first aspect of the invention on a seabed with said drawbar in the loading position;
- providing an elongate element;
- loading said elongate element into said receiving section from the side substantially opposite to the contact surface, along the loading path;
- moving the drawbar into a towing position;
- towing the device across the seabed, such that a trench is formed with the trench forming means; and
- guiding the elongate element into the trench.

According to a fourth aspect of the present invention there is provided an assembly for providing an elongate element in a seabed, comprising:

- a device in accordance with the first aspect of the invention;
- a vessel comprising a towing line, wherein said towing line is connected to the drawbar of said device.

Certain aspects provide the advantage that a plough is provided that is able to be loaded in-situ (for example top-loaded when deployed on a sea bed).

Certain aspects provide the advantage that the plough can be top-loaded without disconnection, removal, or partial removal, of the drawbar.

Certain aspects provide the advantage that the plough can be loaded in-situ without the necessity of additional loading means.

As used herein, it would be understood that 'providing an elongate element in a sea bed' in the present disclosure may be otherwise termed 'guiding an elongate element onto the sea bed' or 'guiding an elongate element into a trench formed in the sea bed'.

As used herein, it may be understood that the term 'loading path' with relation to an elongate element and a receiving section refers to a path followed by an elongate element (or section of elongate element) during the loading of the elongate element into the receiving section. That is, the loading path is the path followed by the elongate element as it is taken from a position external to the receiving section to a position within the receiving section (i.e. to a 'received position' within the receiving section). In the described examples of this disclosure, it may be understood that in 'top-loading' the elongate element (i.e. loading the elongate element from a side substantially opposite to the contact surface of the supporting means), the loading path that is followed by the section of the elongate element being loaded is perpendicular to the axis of said section (rather than being fed into the receiving section axially, where the loading path would be generally coincident with the axis of the elongate element). In other words, in general, during top-loading the section of elongate element is arranged substantially horizontally and then lowered (in the horizontal arrangement) substantially vertically into the receiving section.

As used herein, it would be understood that the terms 'upstream' or 'downstream', with regards to guiding an elongate element through a plough and/or towards a sea-bed, are defined relative to the direction of pipe deployment (i.e. as opposed to the direction of vessel or plough movement).

BRIEF DESCRIPTION OF THE DRAWINGS

Embodiments will now be described by way of example only with reference to the accompanying drawings in which.

In the drawings like reference numerals refer to like parts.

DETAILED DESCRIPTION OF THE INVENTION

Figure 1A:
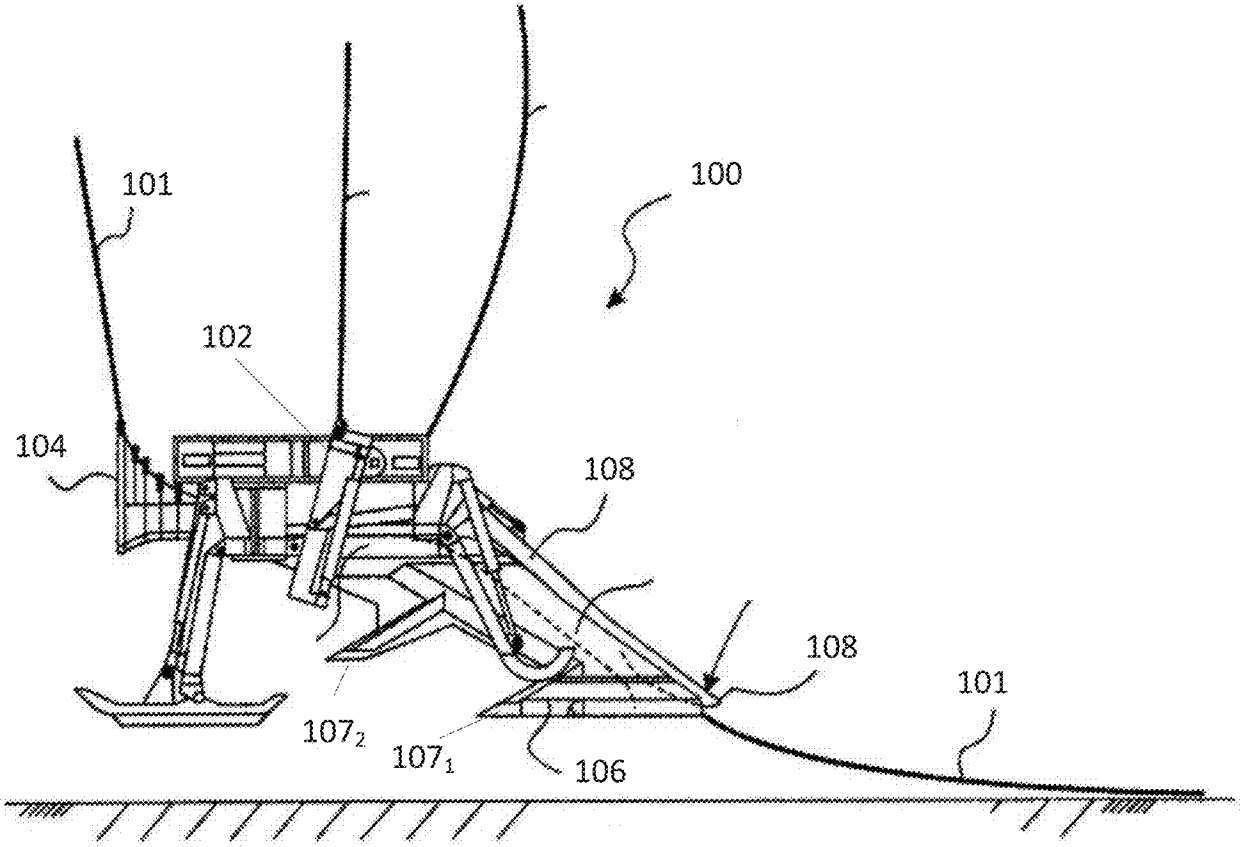
FIGURE 1a PRIOR ART
FIGS. 1*a* and 1*b* illustrate side and plan views of a known plough, respectively.
Figure 1B:
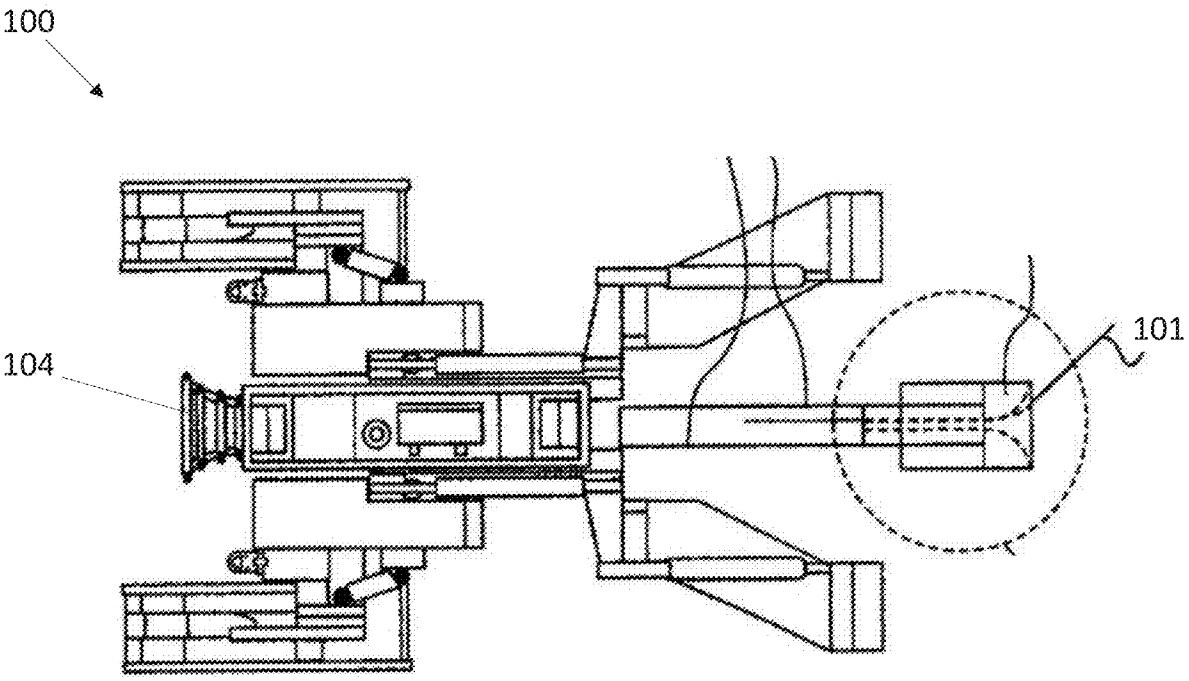
FIGURE 1b PRIOR ART

FIGS. 2*a* to 5*c* illustrate a device for providing an elongate element in a seabed. In this example, the device is a plough 300. The plough 300 includes a main body 340 including trench forming means for forming a trench in a seabed. In this example, the trench forming means comprises a trenching knife, trenching blade or share 306. In this example, the trenching knife 306 includes a plurality of cutting blades $\mathbf{307}_{1\text{-}3}$ in the manner described for the arrangement of FIGS. 1*a* and 1*b*. As the plough 300 traverses the sea-bed the cutting blades $\mathbf{307}_{1\text{-}3}$ of the trenching knife 306 cut a trench in the seabed.

Figure 2A:
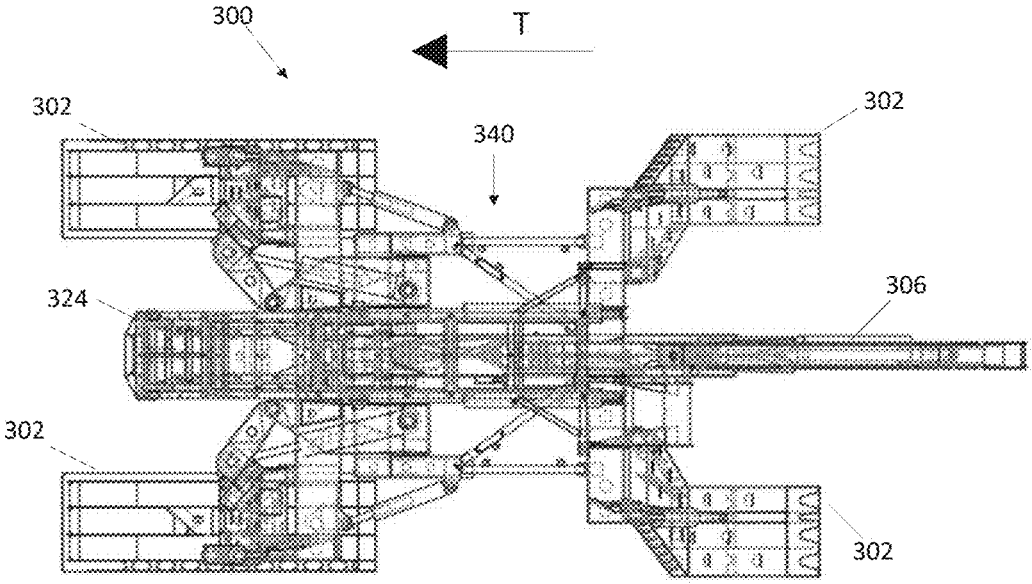
FIG. 2*a* illustrates a plan view of an example of a plough according to the present disclosure.
Figure 2B:
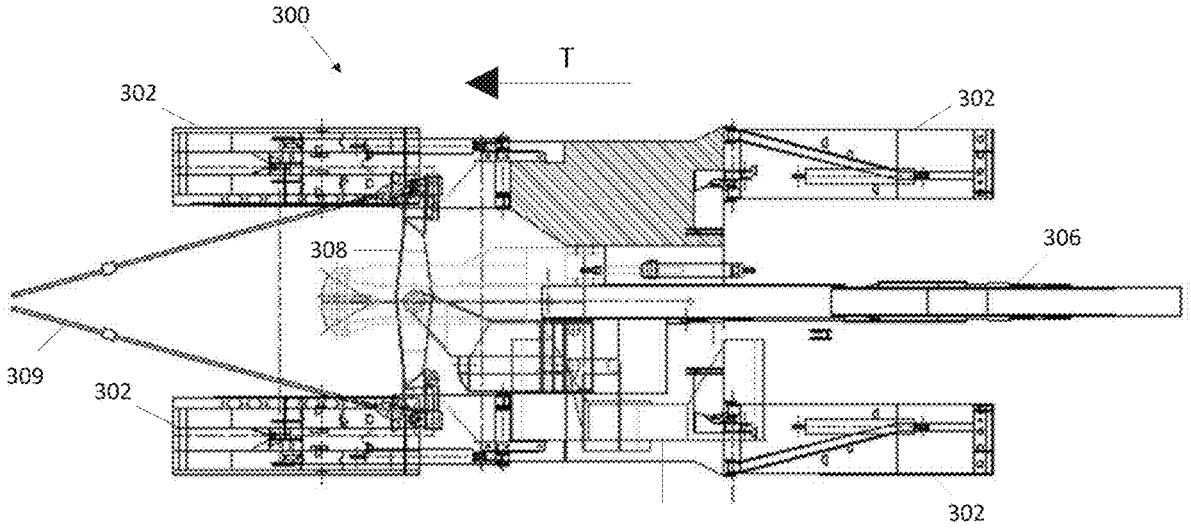
FIG. 2*b* illustrates a plan view of the plough of FIG. 2*a* with some structure (for example the bell mouth removed) for clarity.

The plough 300 includes supporting means with a contact surface for supporting the main body 340 with respect to the seabed. In this example, the supporting means include at least one skid 302. In use the skids sit on the seabed (contacting the seabed via contact surfaces on an underside thereof) and support the main body 340 of the plough thereon. As shown in FIGS. 2*a* and 2*b*, in this example, the plough 300 includes two sets of skids 302 (i.e. front and rear sets of skids, each set having two skids), however in other examples different numbers of skids/sets of skids may be used. In this example, the contact surface is flat. That is, the skids 302 provide a flat contact surface. The provision of a flat contact surface leads to relatively large bearing area.

In this example, the skids 302 are movable relative to the main body 340. In a first position the skids 302 are arranged such that the contact surface thereof is substantially coplanar with a lower surface of the trenching knife 306. Such a first position may be used, for example, when the plough 300 is initially lowered onto the sea bed. As the plough 300 is towed, the lowermost cutting blade $\mathbf{307}_1$ begins to cut the trench. As the trench is cut, the skids 302 may be moved towards the main body 340 of the plough 300 (i.e. upwardly), wherein the depth of the resulting trench is increased (i.e. the distance between the contact surface of the skids 302 and the lowermost cutting blade $\mathbf{307}_1$ or a lower portion of the trench forming means is increased). In a second position the skids 302 are proximal with the main body 340 of the plough 300. That is, in the second position, the distance between the contact surface of the skids 302 and the lowermost cutting blade $\mathbf{307}_1$ is at a maximum, corresponding to the maximum trench depth.

In this example, the main body 340 includes at least one actuator to actuate the skids with respect to said main body 340. Any suitable actuator may be used, for example pneumatic or hydraulic actuators or the like. In this example, there is a separate actuator for each skid, however in other examples there may be a single actuator, or actuator system, configured to actuate the skids.

The main body 340 of the plough 300 further includes a receiving section 380 for receiving an elongate element 350 (or more specifically, for receiving a portion or section of an elongate element). In this example, the receiving section 380 extends along the longitudinal axis of the plough. That is, the axis of the plough that in use is generally aligned with the trenching direction T of the plough 300. The receiving section is configured to receive the elongate element such that the elongate element is in proximity of the plough also generally aligned with the longitudinal axis of the plough so that the elongate element is generally aligned with a trench cut by the trench forming means.

The receiving section 380 may be configured to receive any suitable elongate element, for example a cable, such as a power transmission cable or the like. It would be understood that the receiving section would be sized according to the type of elongate element received therein.

The receiving section is configured to receive the cable from a side of the plough 300 substantially opposite to the contact surface of the plough 300. That is, the plough 300 is configured to be top-loaded, with the cable lowered into the receiving section 380 from above (i.e. from the side of the plough opposite to the contact surface of the plough). In other words, the elongate element is loaded into the receiving section 380 along a loading path (represented by arrow 380 in FIG. 3*c*), the loading path extending from the side of the plough opposite to the contact surface of the plough, substantially downwardly into the receiving section. Put another way, the loading path is located further away from the contact surface than the main body, or the main body is arranged between the loading path and the supporting means.

In this example, the receiving section includes an open channel to allow the cable to be loaded from above. In this example, the open channel includes a substantially U-shaped frame, however, in other examples the receiving section 380 may be shaped in any suitable configuration for receiving an elongate element.

The main body 340 of the plough 300 is adapted to guide the cable 350 from the receiving section, into the trench formed by the trench forming means 306. For example, once loaded, a section of the cable 350 is located into the receiving section. The section of the cable is connected to (i.e. integral with) an upstream section of the cable, which extends to the vessel from which both the cable and plough are deployed. As the plough 300 traverses the sea-bed, the plough 300 moves relative to the cable, and the upstream section passes through the plough and is deposited into the trench formed by the trench forming means, downstream of the plough. In this example, the plough 300 includes a bell mouth 324 located at an upstream end of the receiving section, the bell mouth being adapted to receive the upstream section of cable therethrough, before the cable passes through the receiving section.

The plough further includes a drawbar 308 connected to the main body 340. The drawbar 308 has a towing position, in which the plough 300 is towable in a trenching direction T via a towing line 309 connected to said drawbar 308. The towing line 309 may, for example, be connected to and towed by a vessel (for example the vessel from which the plough 300 is deployed).

Figure 3A:
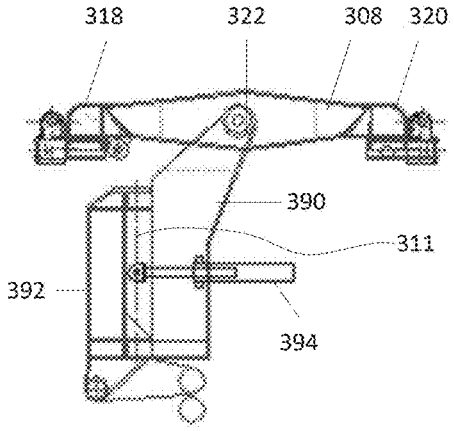
FIG. 3*a* illustrates a side view of a drawbar of the plough of FIGS. 2*a* and 2*b*, in a loading position.
Figure 3B:
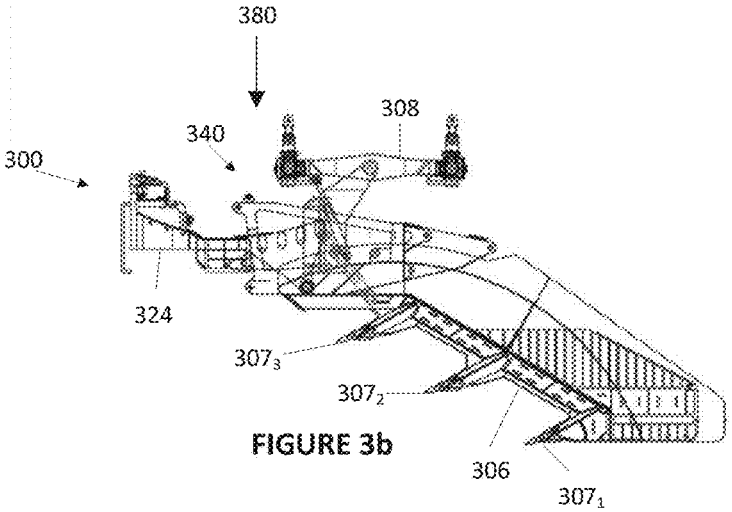
FIG. 3*b* illustrates a side view of the plough of FIGS. 2*a* and 2*b* with the drawbar in the position shown in FIG. 3*a;*

In this example, the drawbar 308 includes a first engagement portion 318, and a second engagement portion 320 spaced apart from said first engagement portion (illustrated best in FIG. 3*b*). Each of the first and second engagement portions 318, 320 are suitable for engaging the towing line 309 (or towing lines). In other words, in a towing position (as illustrated in FIGS. 2*b* and 5*a* to 5*c*), the drawbar 308 extends across the width of the plough 300, with the towline 309 being connected to the drawbar 308 at positions substantially towards the ends of the drawbar, these positions being the first and second engagement portions. In connecting the towing line 309 to the plough 300 at two separate locations (i.e. the first and second engagement portions), the plough 300 can be towed in a more stable manner.

In the towing position, the drawbar 308 extends across the receiving section. In particular, the drawbar 308 extends across the open channel of the receiving section. In this manner, in the towing position, the drawbar 308 prevents the receiving section from receiving a cable from above. That is, in the towing position the drawbar 308 obstructs the loading path into the receiving section (and hence prevents top-loading a cable therein).

The drawbar 308 has a loading position, in which the cable can be loaded into the receiving section along the loading path 380. In the loading position the drawbar 308 is spaced apart from the loading path 380. That is, in the loading position the drawbar 308 does not extend across the open channel of the receiving section in a manner that obstructs the cable being loaded into the receiving section. In other words, the position of the drawbar 308 when in the loading position allows the cable to be received in the loading path (as shown in FIGS. 3*a* to 3*c*).

FIG. 3*a* illustrates a side view of the drawbar 308 of plough 300 in a loading position. FIG. 3*b* illustrates the plough 300 with the drawbar 308 in the position shown in FIG. 3*a*. In the loading position the drawbar 308 is spaced apart from the loading path to allow a cable to be loaded into the receiving section along the loading path (the loading path being vertically downwardly towards to the plough, past the drawbar 308, in FIG. 3*a*). As such, the loading path is free (from the drawbar) to receive the elongate element.

The drawbar 308 is movable from the loading position to the towing position. In this example, the drawbar 308 is movable from said loading position to said towing position around a first axis 311 extending perpendicular to the lateral plane of the plough (that is, the plane of the plough that is parallel to the longitudinal axis of the plough and is (at least substantially) parallel to the seabed). The lateral plane can be defined by the support means, comprising skids 302, of the plough. When the plough 300 is arranged substantially horizontally on a seabed (i.e. in areas where the seabed is flat) this corresponds to the drawbar 308 being movable from said loading position to said towing position around a first axis 311 extending perpendicular with respect to the contact surface of the skids 302. That is, with the plough 300 arranged substantially horizontally on a seabed (i.e. the contact surface is arranged substantially horizontally), the drawbar 308 rotates around a substantially vertical axis 311, with the drawbar 308 moving in a horizontal plane.

Figure 4A:
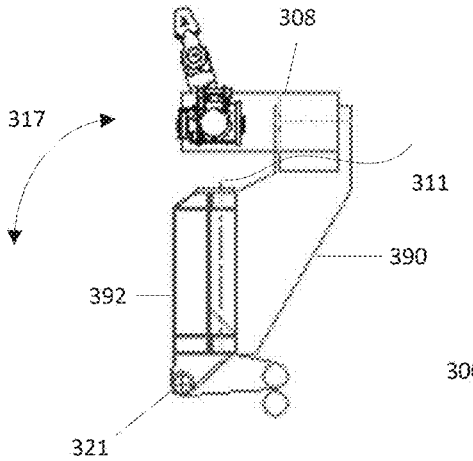
FIG. 4*a* illustrates a side view of a drawbar of the plough of FIGS. 2*a* and 2*b*, in a launch and recovery position.
Figure 4B:
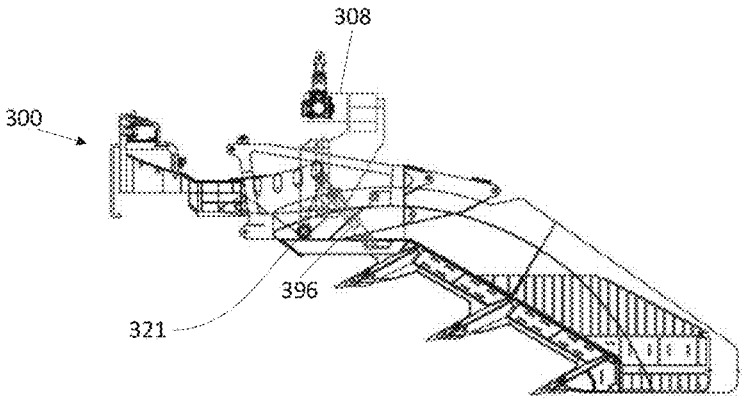
FIG. 4*b* illustrates a side view of the plough of FIGS. 2*a* and 2*b* with the drawbar in the position shown in FIG. 4*a;*

FIG. 4*a* illustrates a side view of the drawbar following rotation around the first axis 311, from the loading position. FIG. 4*b* illustrates the plough 300 with the drawbar 308 in the position shown in FIG. 4*a*. In this example, this position corresponds to a launch and recovery position in which the plough 300 can be launched or recovered (i.e. via the drawbar 308). In some examples the plough 300 may be launched or recovered using the tow-line 309. However, in other examples the plough 300 may be launched or recovered using a separate tow-line (for example in shallow waters).

In the position illustrated in FIG. 4*a*, the drawbar 308 extends across (i.e. over) the receiving section. That is, the drawbar 308 obstructs the loading path into the receiving section, such that the cable may not be top-loaded.

Figure 5A:
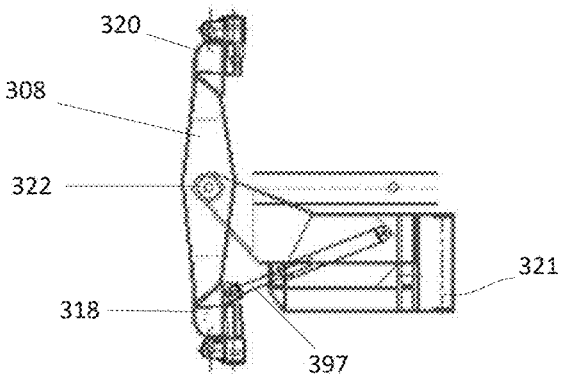
FIGS. 5*a* and 5*b* illustrate plan and side views, respectively, of a drawbar of the plough of FIGS. 2*a* and 2*b*, in a towing position.
Figure 5B:
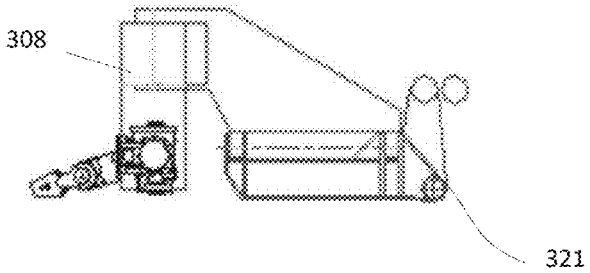
Figure 5C:
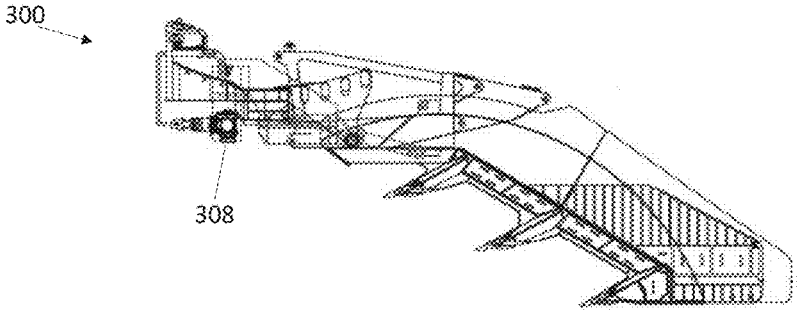
FIG. 5*c* illustrates a side view of the plough of FIGS. 2*a* and 2*b* with the drawbar in the position shown in FIG. 5*b;*

In this example the movement of the drawbar 308 from the loading position to the towing position involves a rotation of the drawbar about more than one axis (that is, the transition from the loading position to the towing position is a two-stage movement). As shown in FIG. 5*b*, in this example the drawbar 308 is movable around a second axis 321 that extends at least substantially perpendicular to the trenching direction T and the first axis 311. In other words, with the plough 300 arranged substantially horizontally on a seabed, the drawbar 308 rotates around a substantially horizontal axis 321, perpendicular to the trenching direction T. This articulates the draw bar 308 downwardly into a towing position (as shown in FIGS. 5*a* and 5*b*). In FIG. 4*a*, the axis 321 extends into the page, the direction of rotation around the second axis being indicated by arrow 317.

In this example, the drawbar 308 is rotatably coupled to the main body of the plough 300 to allow the rotations around the two separate axis 311 and 321. In this example the drawbar 308 is rotatably coupled to the main body of the plough via at least one support frame or support assembly. In particular, in this example, the drawbar 308 is coupled or mounted to a first support frame 390, the first support frame 390 being rotatably coupled to the main body of the plough 300 to allow rotation of the drawbar 308 around the first axis 311.

In this example, the plough 300 includes actuator means (i.e. actuators) for moving the drawbar from the loading position to the towing position (that is, the actuating the rotation of the drawbar around the axes 311 and 321). Any suitable actuator may be used, for example pneumatic or hydraulic actuators or the like may be used.

In this example, the first support frame 390 is rotatably coupled to the main body of the plough 300 via a second support frame 392. Actuator 394 is configured to control the rotation of the first support frame 390 with respect to the second support frame 392 (i.e. around axis 311). As the actuator 394 actuates, the first support frame 390 rotates relative to the second support frame 392 (the second support frame 392 remaining in a fixed position) to move the drawbar 308 from the loading position to the launch and recovery position.

In this example, the second support frame 392 is itself rotatably mounted to the main body of the plough 300 to allow rotation of the drawbar 308 around the second axis 321. Actuator 396 is configured to control the rotation of the second support frame 392 with respect to the main body of the plough 300 (i.e. around the second axis 321). As the actuator 396 actuates, the first and second support frames 390, 392 rotate relative to the main body of the plough 300 to move the drawbar 308 from the launch and recovery position to the towing position. In this example, the drawbar 308 is pivotally mounted. That is, as shown in FIG. 3*a* the drawbar 308 is mounted to the support frame 390 via a pivot 322, arranged substantially centrally between the first and second engagement portions 318, 320. This allows the tensions in the towlines to be regulated (for example to equalise the tow loads if passive) or to allow the plough to be steered. In particular, an actuator 397 may be arranged to actuate the drawbar 308 with respect to the first support frame 390, wherein said drawbar 308 is actuatable around said pivot 322. In particular, said actuator 397 has a first end that is connected at/near the first engagement portion 318 of the drawbar 308 and a second end opposite to said first end that is connected to the first support frame 390 (as can be seen in FIG. 5*a*).

Any suitable actuator may be used for actuators 394 and 396, for example pneumatic, hydraulic or electric actuators or the like may be used (in particular hydraulic or electric actuators due to the ambient pressure).

FIGS. 3*a* to 5*c* illustrate the movement of the drawbar 308 from a loading position to a towing position. It would be understood that the drawbar 308 may be moveable between the loading position and the towing position, with the movement of the drawbar from the towing position to the loading position being the reverse of the movement of the drawbar from the loading position to the towing position. In other words, in this example, in moving from the towing position to the loading position, the drawbar is articulated upwards into the launch and recovery position and then rotated around the vertical axis to rotate the drawbar away from the cable loading path to allow the cable to be lowered vertically into the plough. In either example, the drawbar 308 may be moved back to the loading position from the towing position, for example to unload cable, load new cable or once a predetermined length of cable has been buried.

In some examples, the plough 300 may be provided initially with the drawbar 308 in the loading position (for example the plough 300 may be deployed with the drawbar 308 in the loading position). Following the deployment of the plough 300, the cable may then be loaded into the receiving section, the drawbar 308 moved to the towing position and the plough 300 towed to form a trench, the cable being deposited therein during the towing process. In other examples, the plough 300 may be provided initially with the drawbar 308 in the towing position. Once deployed, the drawbar 308 may then be moved to the loading position so the cable can be then loaded in the receiving section.

In some examples, it may be required to also move/reposition other components within the plough 300 to allow the cable to be top-loaded. For example, the bell mouth 324 and/or the depressor 370 may be movable between a loading position (in which the cable can be loaded into the receiving section along the loading path 380) and an operational position (i.e. the position during a ploughing operation).

Figure 6A:
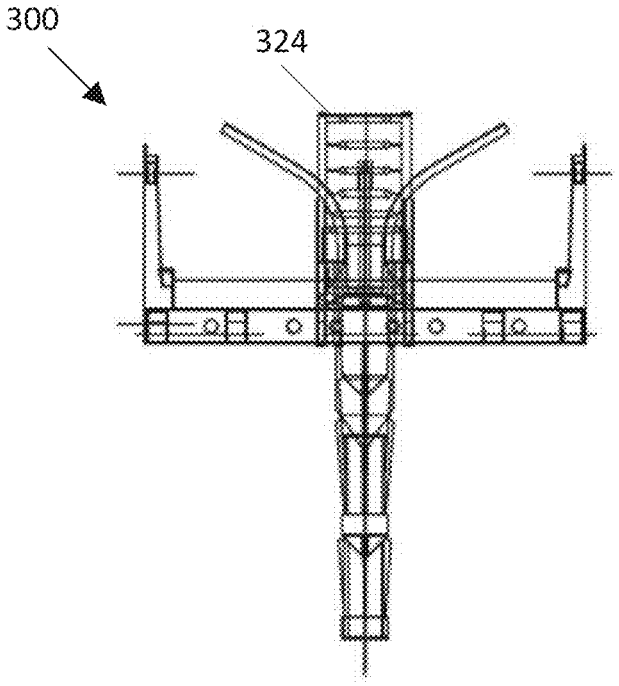
FIGS. 6*a* and 6*b* illustrate a front view of the plough of FIGS. 2*a* and 2*b* with the bell mouth in the operational and loading positions respectively.
Figure 6B:
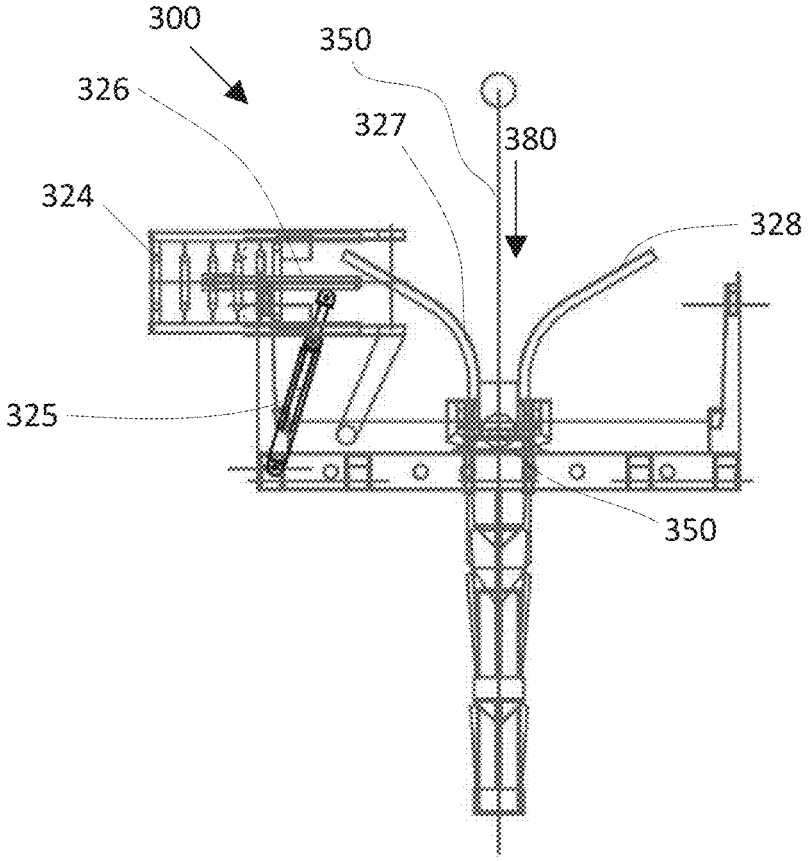

FIGS. 6*a* and 6*b* illustrate a front view of the plough 300 with the bell mouth 324 in operational and loading positions respectively. In this example, the bell mouth 324 is movable from the operational position to the loading position around an axis extending substantially parallel to the said trenching direction T. That is, the bell mouth 324 is rotated away from the loading path. To this end, the (main body of the) plough 300 comprises a guiding frame to which the bell mouth 324 is movably (e.g. slidably or pivotably) connected with a frame part 326 of the bell mouth 324. The guiding frame comprises two guide members 327 and 328 which together form the guiding frame (having a V shaped cross section). The guiding frame converges towards/into the receiving section 380. Accordingly, the guiding frame is configured to guide the cable 350 to a central position in the receiving section. The frame part 326 of the bell mouth 324 is movably connected with and movable along a single guide member 327 of the guiding frame of the plough 300. Said (frame part 326 of said) bell mouth 324 is movable with respect to said guide member 327 by mean of a (schematically drawn) actuator 325. In particular, said actuator 325 is arranged to actuate the frame part 326 of the bell mouth 324 with respect to the guiding frame 327, towards and away from the receiving section 380.

Figure 7A:
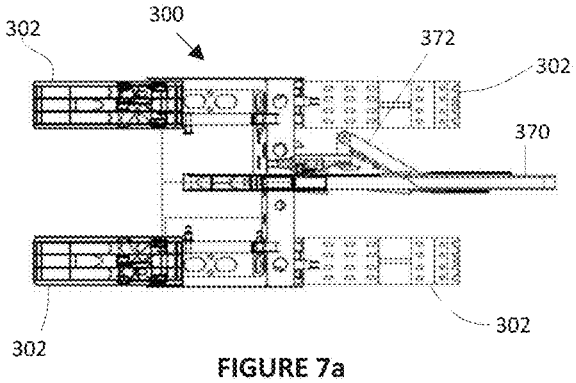
FIGS. 7*a* and 7*b* illustrate plan and side views of the plough of FIGS. 2*a* and 2*b* with the depressor in the operational position.
Figure 7B:
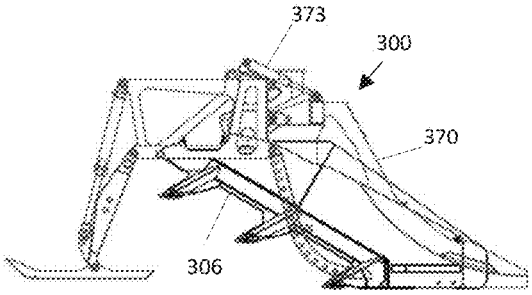
Figure 8A:
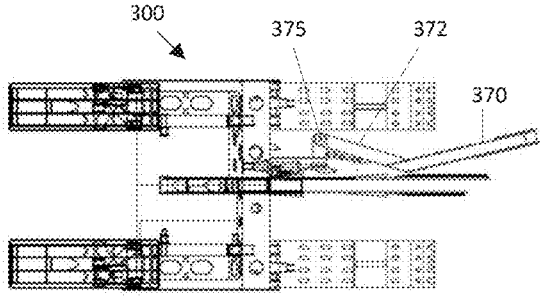
FIGS. 8*a* and 8*b* illustrate plan and side views of the plough of FIGS. 2*a* and 2*b* with the depressor in the loading position.
Figure 8B:
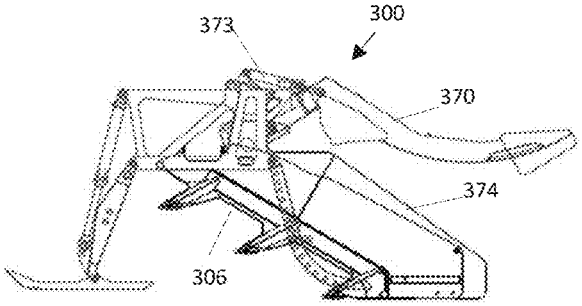

FIGS. 7*a* and 7*b* show the plough 300 of the present invention, wherein the depressor 370 is in the operational position, and FIGS. 8*a* and 8*b* show the plough 300 of the present invention, wherein the depressor 370 is in the loading position. The depressor 370 extends from a downstream side of the main body, the depressor 370 being arranged to guide the elongate element into a trench cut by the ploughing knife 306. As described above, the depressor 370 is configured to cooperate with a rear surface of the ploughing knife 306, such that the elongate element is guided between the depressor 370 and the ploughing knife 306 towards the trench, before being urged downwardly into the trench by the depressor 370. In this example, the depressor is movable from the operational position to the loading position by lifting the depressor 370 away from the ploughing knife 306 and displacing or rotating the depressor 370 away from the loading path. In this example, the depressor 370 is mounted on frame or support structure 372, the support structure 372 being positioned away from, or at a side of, the loading path. The support structure 372 is pivotably connected with the base frame of the plough 300, wherein the support structure 372 (and thus the depressor 370) is pivotable with respect to the plough 300 about pivot axis 375. The pivot axis 375 is perpendicular with respect to the contact surface of the supporting means 302. When seen from above, the pivot axis 375 is located offset from the centre of the plough (i.e. outside of the receiving section). As such, the depressor 370 can be moved away (e.g. fully removed from) from the loading path towards the receiving section 380, wherein the loading path is free from the depressor 370 such that the receiving section 380 is open for receiving an elongate element 350. When the depressor 370 is fully removed from the loading path, the cable can be top loaded into the receiving section.

For lifting the depressor 370, the support structure 372 is connected with the base frame of the plough 300 via an actuator 373 for actuating the support structure 372 (and the depressor 370) with respect to the plough 300 towards and away from said trenching means 306. FIGS. 9*a* to 12 illustrate the deployment of a plough 500. Plough 500 may be a plough as described in any of the previous examples, or variants thereof.

Figure 9A:
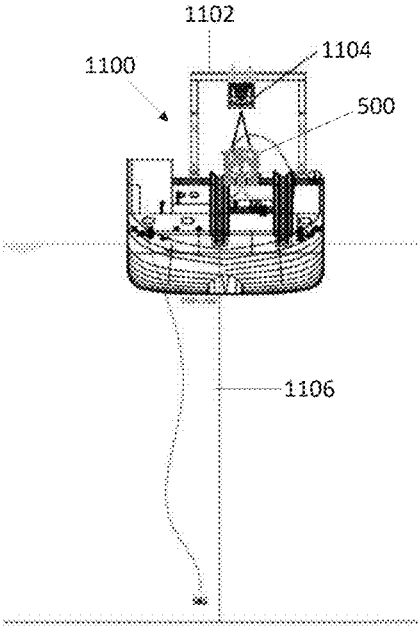
FIGS. 9*a* and 9*b* illustrate rear and side views respectively of a vessel including a plough, the plough being located on the vessel deck.
Figure 9B:
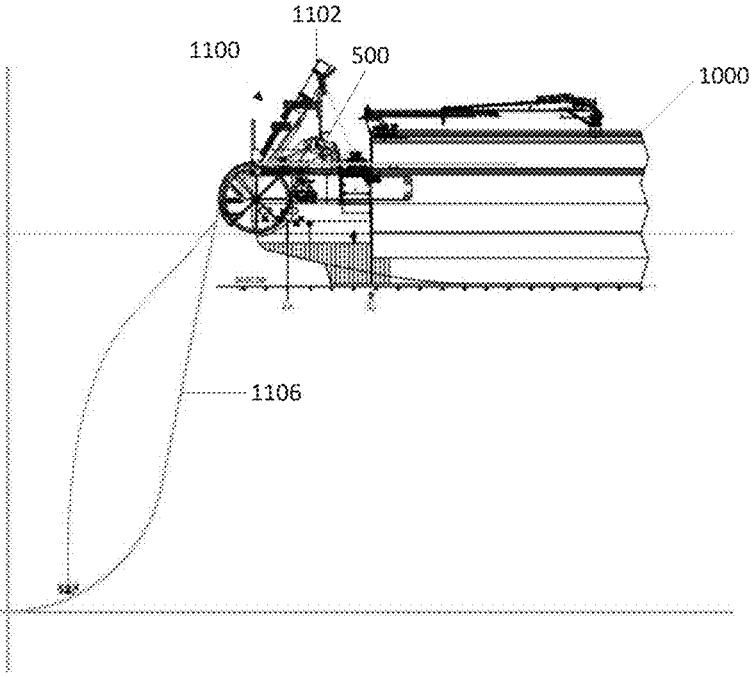
Figures 10A, 10B:
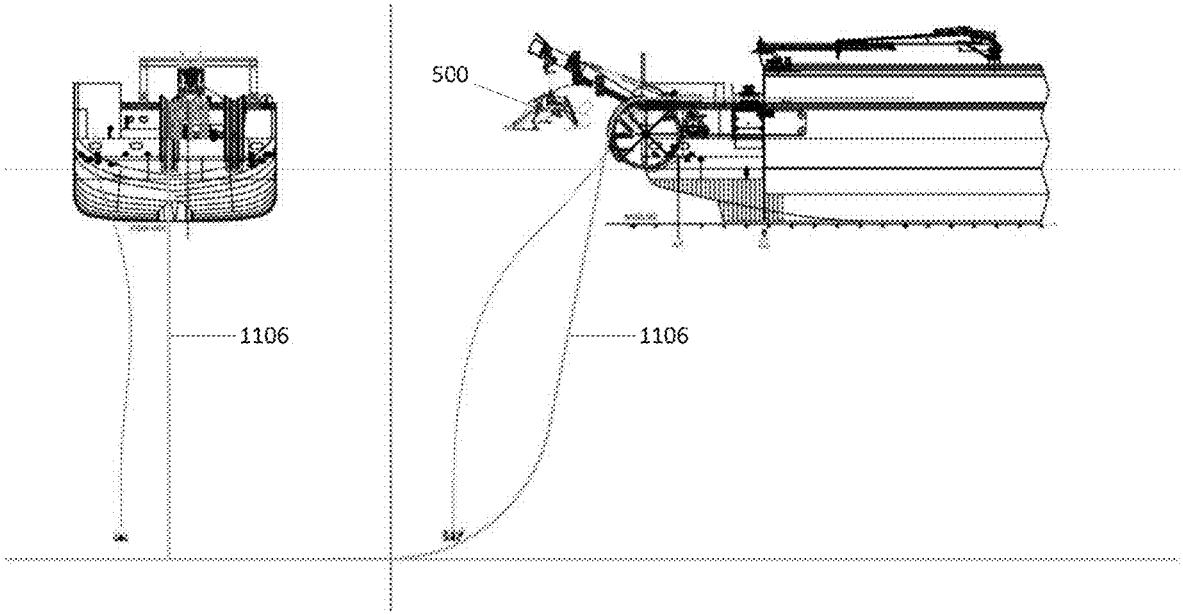
FIGS. 10*a* and 10*b* illustrate rear and side views respectively of the arrangement of FIGS. 9*a* and 9*b*, during deployment of the plough to the seabed.
Figures 11A, 11B:
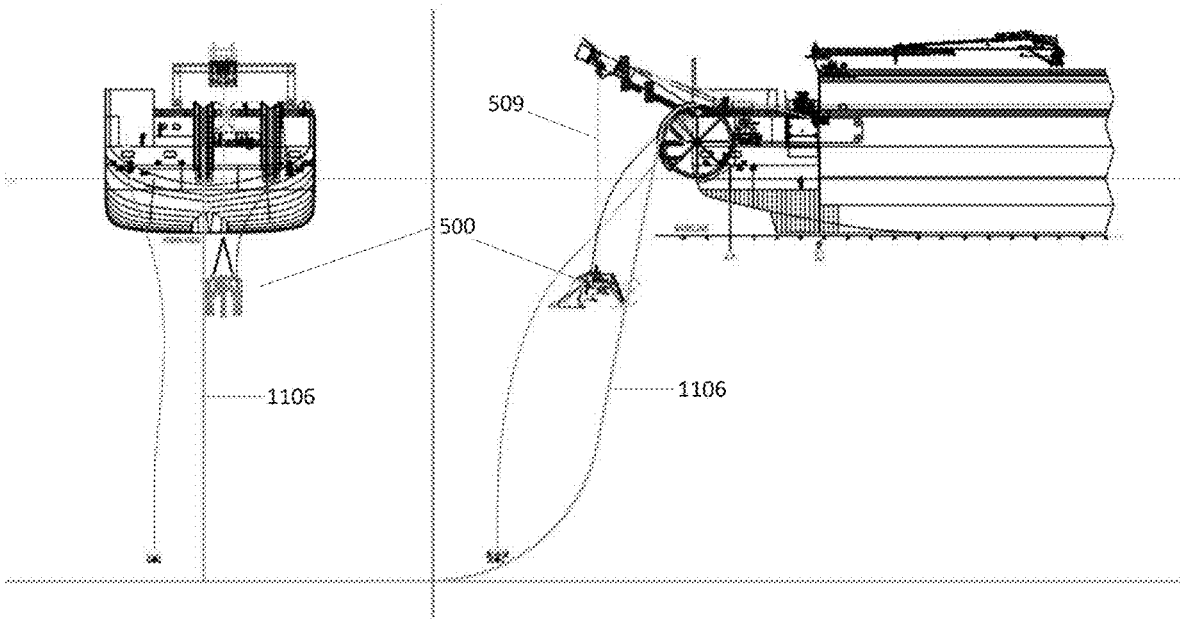
FIGS. 11*a* and 11*b* illustrate rear and side views respectively of the arrangement of FIGS. 9*a* and 9*b*, during deployment of the plough to the seabed.

In this example, as illustrated in FIGS. 9*a* and 9*b*, the plough 500 is initially situated on a deck of a vessel 100. The plough 500 is deployed from the deck of the vessel 1000 by deployment means 1100. Any suitable deployment means may be used. In this example, the deployment means 1100 includes a loading frame 1102, pivotable with respect to the vessel, and a lowering sheave block 1104. As illustrated in FIGS. 10*a* and 10*b*, the plough is attached to the lowering sheave block 1104 and the loading frame 1102 is pivoted, such that the plough is suspended over a side of the vessel (specifically the side of the vessel from which the cable 1106 is also deployed).

In this example, the plough 500 is suspended (and subsequently lowered) by the tow-line 509 that will be used to tow the plough 500, for example with the tow-line 509 attached to the drawbar of the plough 500 in the launch and recovery position. However, in other examples a separate tow-line, chain or cable may be used to deploy the plough 500. In such examples, the drawbar of the plough 500 may initially be in the loading position.

Figure 12:
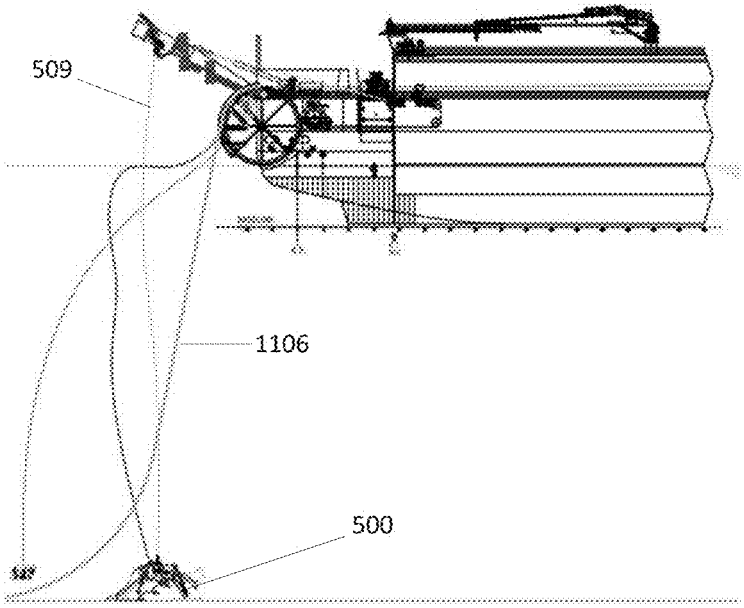
FIG. 12 illustrates a side view of the arrangement of FIGS. 9*a* and 9*b*, the plough being located on the seabed.

The deployed plough 500 is illustrated in FIG. 12. Following deployment, the plough 500 is then prepared for loading. For example, when the plough 500 is deployed in the launch and recovery position, the drawbar may be moved to the loading position directly from the launch and recovery position. In other examples, the drawbar may be moved to the towing position to allow the plough 500 to be towed to a suitable location, prior to moving the drawbar to the loading position. In other examples the plough may be deployed with the drawbar in the launch position (for example when launched via an additional tow-line). Once the drawbar is in the loading position, the cable 1106 is then lowered into the receiving section of the plough. After the cable 1106 is loaded into the receiving section of the plough 500, the drawbar is moved to the towing position, such that the trenching and cable laying operation can begin. That is, the plough can be towed across the seabed, such that a trench is formed with the trench forming means, with the cable 1106 being guided into the trench. At a later stage in the trenching and cable laying operation, the drawbar may be moved from the towing position to the loading position, to allow the cable to be unloaded and re-loaded (or a new cable loaded) as required.

As outlined below, certain aspects of the advantages described above have advantages over known devices for providing an elongate element in a seabed. For example, rotating the drawbar around a (substantially) vertical axis (i.e. moving the drawbar in a horizontal plane) to clear the loading path for loading the plough from above helps to prevent excess slack in the towline which could subsequently catch and snag. For example, when rotating the drawbar around a horizontal axis only (i.e. moving the drawbar in a vertical plane) to clear the loading path for top loading, one of the tow cables (connected at an end of the drawbar) may become slack. The slack cable can obstruct the loading of the cable. This is avoided by rotating the drawbar around a vertical axis, such that tension is maintained in both tow cables (connected at the ends of the drawbar).

In the above described examples, the trench forming means is a trench knife. However in other examples, other suitable trench forming means may be used, for example a jet cutting means or similar may be used.

The device may include grabbing or capturing means for grabbing or capturing the elongate element. That is, the grabbing or capturing means may grab the elongate element and actively draw it in, or deposit it within, the receiving section.

The device may include guiding means 327, 328, for guiding the cable towards the receiving section 380. The guiding means 327, 328 may be configured to guide the cable 350 from above the plough 300, into the receiving section 380 and/or direct the cable towards the receiving section 380. In some examples, the guiding means may include a detection system configured to detect the approach of the cable to the device during the loading process. The detection system may include at least one sonar system, for example forward and aft upwardly (nominally) facing sonar systems. The detection system would be utilised by the device to manoeuvre the cable so as to land correctly in the plough.

It would be understood that although the above described arrangements are described as being configured for top-loading, they may also be loaded axially (i.e. through loaded through the bell mouth into the receiving section).

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

A normal reference frame relating to (components of) the plough may be used when assessing the orientation thereof. Accordingly, when the plough is positioned on a flat ground surface, "horizontal" is parallel to said flat ground surface, and "vertical" is perpendicular to said flat ground surface (i.e. upwards from said flat ground surface), even when said flat ground surface is inclined.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A device for providing an elongated element in a seabed, the device comprising:

a main body having:

trench forming means for forming a trench in a seabed, and a receiving section for receiving a section of an elongated element, wherein said main body is adapted to guide said elongated element, from said receiving section, into a trench formed by said trench forming means;

supporting means defining a contact surface for supporting said main body with respect to said seabed, wherein the receiving section is configured to receive the section of the elongated element from a side substantially opposite to the contact surface along a loading path, the loading path being perpendicular to the axis of the section of the elongated element, wherein the receiving section includes a channel extending from an upstream end to a downstream end, wherein the channel is an open channel that is open between the upstream end and the downstream end, wherein the receiving section is configured to receive the section of the elongated element into the open channel along the loading path from above; and a drawbar connected to said main body;

wherein said drawbar is movable from a loading position to a towing position, wherein in the towing position the drawbar extends across the open channel of the receiving section and said device is towable in a trenching direction via a towing line connected to said drawbar, wherein in the loading position the drawbar does not extend across the open channel of the receiving section and is spaced apart from the loading path to allow the section of the elongated element to be loaded into the receiving section along the loading path.

2. The device of claim 1, further comprising actuator means for moving the drawbar from said loading position to said towing position.

3. The device of claim 1, wherein, in said towing position, said drawbar obstructs the loading path into said receiving section.

4. The device of claim 1, wherein the drawbar is movable between the loading position and the towing position.

5. The device of claim 1, wherein said drawbar comprises:

a first engagement portion; and a second engagement portion spaced apart from said first engagement portion, each of said first and second engagement portions being suitable for engaging a towing line.

6. The device of claim 1, wherein said drawbar is movable from said loading position to said towing position around at least a first axis extending substantially perpendicular with respect to said contact surface.

7. The device of claim 1, wherein the drawbar is movable around a second axis that extends at least substantially perpendicular to said trenching direction and said first axis.

8. The device of claim 1, wherein the device includes a bell mouth located at an upstream end of the receiving section, the bell mouth being adapted to receive an elongate element therethrough, wherein the bell mouth is movable between a loading position and an operational position.

9. The device of claim 1, wherein the device includes a depressor extending from a downstream side of the main body, the depressor being arranged to guide the elongate element into a trench cut by the trench forming means, wherein the depressor is movable between a loading position and an operational position.

10. The device of claim 1, wherein said trench forming means comprise a trenching knife.

11. The device of claim 1, wherein said supporting means comprises at least one skid and at least one actuator to actuate said at least one skid with respect to said main body.

12. The device of claim 1, wherein said receiving section comprises a U-shaped frame, or a V-shaped frame for centralizing said elongate element.

13. The device of claim 1, said device further comprising guiding means for guiding an elongated element towards said receiving section.

14. The device of claim 1, said device further comprising grabbing means for grabbing an elongated element.

15. A method of providing an elongated element in a seabed, the method comprising the steps of:

providing a device in accordance with claim 1 on a seabed with said drawbar in the loading position;

providing an elongated element;

loading said elongated element into said receiving section from the side opposite to the contact surface, along the loading path;

moving the drawbar into a towing position;

towing the device across the seabed, such that a trench is formed with the trench forming means; and guiding the elongated element into the trench.

16. An assembly for providing an elongated element in a seabed, comprising:

a device in accordance with claim 1;

a vessel comprising a towing line, wherein said towing line is connected to the drawbar of said device.

* * * * *